US007189073B2

(12) United States Patent
Pennell et al.

(10) Patent No.: US 7,189,073 B2
(45) Date of Patent: Mar. 13, 2007

(54) BURNER WITH STAGED FUEL INJECTION

(75) Inventors: Douglas Pennell, Altson (GB); Adnan Eroglu, Untersiggenthal (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 11/006,809

(22) Filed: Dec. 8, 2004

(65) Prior Publication Data

US 2005/0175948 A1 Aug. 11, 2005

Related U.S. Application Data

(63) Continuation of application No. 10/398,374, filed as application No. PCT/IB01/01817 on Oct. 3, 2001, now abandoned.

(30) Foreign Application Priority Data

Oct. 16, 2000 (DE) ..... 100 51 221

(51) Int. Cl.
*F23D 14/24* (2006.01)
*F23D 14/78* (2006.01)

(52) U.S. Cl. ..... 431/353; 431/8; 431/350; 431/167

(58) Field of Classification Search ..... 431/10, 431/160–167, 350, 353
See application file for complete search history.

(56) References Cited

U.S. PATENT DOCUMENTS 1,701,249 A * 2/1929 Wallstrom ..... 431/166
3,149,613 A * 9/1964 Anschutz et al. ..... 122/235.11
4,603,548 A 8/1986 Ishibashi et al.
4,854,127 A 8/1989 Vinson et al.
5,085,575 A 2/1992 Keller et al.
5,244,380 A 9/1993 Döbbeling et al.
5,307,634 A 5/1994 Hu
5,375,995 A 12/1994 Döbbeling et al.
5,394,688 A 3/1995 Amos
5,482,457 A 1/1996 Aigner et al.
5,489,203 A 2/1996 Döbbeling et al.

(Continued)

FOREIGN PATENT DOCUMENTS

DE 2 317 260 11/1973

(Continued)

OTHER PUBLICATIONS

International Search Report for PCT Appl. No. PCT/IB01/01817 (Jan. 3, 2002).
Search Report from DE 100 51 221.6 (Mar. 24, 2004).

*Primary Examiner*—Carl D. Price
(74) *Attorney, Agent, or Firm*—Cermak & Kenealy, LLP; Adam J. Cermak

(57) ABSTRACT

A burner with staged fuel injection includes at least two separate stages (4*a*, 4*b*) for fuel injection arranged along the swirl body (1). The burner is distinguished in that, between the first and the second stage (4*a*, 4*b*), a separating element (8) is provided, which extends in the direction of the combustion chamber (3) and separates the combustion air flow which enters in the region of the first stage (4*a*) from the combustion air flow which enters in the region of the second stage (4*b*). The burner can be operated with low combustion pulsations even in the case of low burner powers.

4 Claims, 1 Drawing Sheet

U.S. PATENT DOCUMENTS

| | | | |
|---|---|---|---|
| 5,562,441 | A | 10/1996 | Döbbeling et al. |
| 5,586,878 | A | 12/1996 | Döbbeling et al. |
| 5,674,066 | A | 10/1997 | Hausermann et al. |
| 5,699,667 | A | 12/1997 | Joos |
| 5,727,938 | A | 3/1998 | Knöpfel |
| 5,800,160 | A | 9/1998 | Knöpfel et al. |
| 5,865,024 | A | 2/1999 | Kress et al. |
| 5,876,196 | A | 3/1999 | Knöpfel et al. |
| 5,921,770 | A | 7/1999 | Sattelmayer |
| 5,944,511 | A | 8/1999 | Ruck |
| 5,954,496 | A | 9/1999 | Dobbeling et al. |
| 5,980,240 | A | 11/1999 | Krautzig et al. |
| 5,984,670 | A | 11/1999 | McMillan et al. |
| 6,019,596 | A | 2/2000 | Knöpfel et al. |
| 6,027,331 | A | 2/2000 | Döbbeling et al. |
| 6,059,565 | A | 5/2000 | Knöpfel et al. |
| 6,102,692 | A | 8/2000 | Döbbeling et al. |
| 6,126,439 | A | 10/2000 | Knöpfel et al. |
| 6,270,338 | B1 | 8/2001 | Eroglu et al. |
| 6,331,109 | B1 | 12/2001 | Paikert et al. |
| 6,558,154 | B2 | 5/2003 | Eroglu et al. |
| 2003/0152880 | A1 | 8/2003 | Eroglu et al. |
| 2004/0029058 | A1 | 2/2004 | Eroglu |

FOREIGN PATENT DOCUMENTS

| | | | |
|---|---|---|---|
| DE | 44 46 945 | | 7/1996 |
| DE | 196 54 008 | | 6/1998 |
| EP | 0 321 809 | | 6/1989 |
| EP | 0 780 629 | | 6/1997 |
| JP | 06-74415 | * | 3/1994 |
| WO | WO93/17279 | | 9/1993 |
| WO | 99/19674 | | 4/1999 |

* cited by examiner

BURNER WITH STAGED FUEL INJECTION

This application is a Continuation of, and claims priority under 35 U.S.C. § 120 to, U.S. application Ser. No. 10/398,374, filed 9 Oct. 2003, "Burner with Staged Fuel Injection", by the inventors hereof (now abandoned), which was a U.S. National Stage application under 35 U.S.C. § 371 of International Application Number PCT/IB01/01817, filed 3 Oct. 2001, published as WO 02/33324 in German, and claims priority under 35 U.S.C. § 119 to German application number 100 51 221.6, filed 16 Oct. 2000, the entireties of all of which are incorporated by reference herein.

BACKGROUND OF THE INVENTION

1. Field of the Invention

The present invention relates to a burner with staged fuel injection, which is composed of a swirl generator for a combustion air stream and means for the introduction of fuel into the combustion air stream, the means for the introduction of fuel into the combustion air stream comprising at least one first fuel supply with a first group of fuel outlet orifices and a second fuel supply with a second group of fuel outlet orifices downstream of the first group of fuel outlet orifices, and the first and second group of fuel outlet orifices and also inlet orifices for the combustion air stream being arranged along the swirl space formed by the swirl generator. A preferred field of use for a burner of this type is application in steam and gas turbine technology.

2. Brief Description of the Related Art

EP 0 321 809 B1 discloses a conical burner consisting of a plurality of shells, what is known as a double-cone burner. By means of the conical swirl generator which is composed of a plurality of shells and forms inside it a swirl space, a closed swirl flow in the conical head is generated, which, because of the increasing swirl along the cone vertex, becomes unstable and changes to an annular swirl flow with backflow in the core. The shells of the swirl generator are composed in such a way that tangential air inlet slits for combustion air are formed along the burner axis. At the inflow edge of the cone shells which occurs as a result, supplies for the premixing gas, that is to say the gaseous fuel, are provided, which have outlet orifices for the premixing gas which are distributed along the swirl space in the direction of the burner axis. The gas is injected through the outlet orifices or bores transversely to the air inlet gap. This injection leads, in conjunction with the swirl of the combustion-air/fuel-gas flow, said swirl being generated in the swirl space, to a good intermixing of the fuel gas or premixing gas with the combustion air. Good intermixing is the precondition, in premixing burners of this type, for low $NO_x$ values during the combustion operation.

For a further improvement in a burner of this type, EP 0 280 629 A2 discloses a burner for a heat generator, said burner having, after the swirl generator, an additional mixing zone for the further intermixing of fuel and combustion air. This mixing zone may be designed, for example, as a following tube, into which the flow emerging from the swirl generator is transferred without any appreciable flow losses. By means of this additional mixing zone, the degree of intermixing can be further increased and consequently the pollutant emissions can be reduced.

FIG. 1 shows diagrammatically an example of burners of this type, in which the fuel is mixed with the inflowing combustion air via outlet orifices in supply ducts arranged along the burner axis in the swirl body 1. The figure illustrates, in this case, the conical swirl body 1 of the burner, together with the swirl space 1*a* which is surrounded by said swirl body and along which run the fuel supplies, together with the outlet orifices 2, indicated in the figure by arrows for injected fuel. These fuel supplies are designed, as a rule, as individual ducts which have a fixed distribution of the fuel outlet orifices 2 along the burner axis. Furthermore, in FIG. 1, a piloting lance 5 can be seen, via which the fuel is injected directly into the swirl space 1*a* during the start-up of the burner. With increasing load, a changeover then takes place from this piloting stage to premixing operation, in which the fuel is intermixed with the inflowing combustion air via said fuel outlet orifices 2.

A further known burner geometry of a premixing burner is known from WO 93/17279. In this arrangement, a cylindrical swirl generator with an additional conical inner body is used. The premixing gas is injected into the swirl space likewise via supplies with corresponding outlet orifices which are arranged along the axially running air inlet slits. The piloting supply of this burner is provided at the end of the conical inner body. Piloting, however, leads to increased $NO_x$ emissions, since, in this operating mode, only insufficient intermixing with the combustion air can take place.

In all known burner systems, a single-stage supply of the fuel is provided in the premixing mode. The size, distribution, arrangement, spacing and number of the outlet orifices of the fuel supply along the burner axis must in this case be optimized in order to fulfil the requirements for low emissions, the extinction limit and the backflash limit and also the requirements for combustion stability. In this case, it is virtually impossible to fulfil all these requirements by means of a fixed distribution of the outlet orifices, even under changing operating and ambient conditions.

A further disadvantage of the known methods for the operation of premixing burners is that these are optimized for low emissions and low combustion oscillations under full-load conditions. In order to start up the burner and start the gas turbine, an additional piloting stage is required, which, however, causes the emission values to rise markedly.

In a parallel patent application of the applicant, to solve these problems, a burner arrangement was proposed, in which the means for the introduction of fuel into the combustion air stream comprise at least one first fuel supply with a first group of fuel outlet orifices for a first premixing fuel quantity and a second fuel supply with a second group of fuel outlet orifices, downstream of the first group of fuel outlet orifices, for a second premixing fuel quantity. The fuel supplies with the fuel outlet orifices are in this case arranged on the swirl body along the swirl space in the longitudinal direction of the burner and are subdivided into at least two ducts for the fuel which are independent of one another. The use of a burner system of this type with staged fuel injection makes it possible to have a markedly widened operating range, as compared with single-stage burner systems. In particular, the operating mode of the burner can be adapted optimally to the respective operating load in terms of the emissions. Furthermore, a fuel supply via the piloting lance is no longer necessary, since operating solely with fuel outlet orifices of the first stage (for example, 2*a* in FIG. 2) gives rise to sufficiently high local temperatures on the burner axis, while the overall adiabatic temperature continues to be low.

The extinction limit of a burner with a fully premixed fuel/air mixture has an extinction limit above 1600 K. Modern AAP gas turbines are operated, during idling and under low load, with a fuel/air mixture which, during combustion, generates an adiabatic temperature of 900 to 1600 Kelvin. It is therefore impossible to burn the fuel in all the available combustion air, so that it is necessary to enrich the core air in the burner by piloting in the region of the burner neck. This relates, in particular, to the abovementioned burners of the prior art with single-stage fuel injection.

The burners, developed by the applicant, with multistage fuel injection by the division of the fuel supplies into two separate regions show, in particular, a reduction in the $NO_x$ emissions and in the intensity of the combustion pulsations at higher flame temperatures above 1650 K. However, the problem of pulsations still arises at temperatures below 1500 K when the first stage is operated essentially alone and therefore performs a function similar to that of a piloting stage.

The object of the present invention is to provide a burner which generates a low level of pulsations even at lower combustion temperatures of below 1600 K.

SUMMARY OF THE INVENTION

A burner embodying principles of the present invention with staged fuel injection is composed essentially of a swirl generator for a combustion air stream and means for the introduction of fuel into the combustion air stream. The means for the introduction of fuel into the combustion air stream comprise at least one first fuel supply with a first group of fuel outlet orifices and a second fuel supply with a second group of fuel outlet orifices offset from the first group of fuel outlet orifices. The two groups of fuel outlet orifices and also inlet orifices for combustion air, as a rule air inlet slits, are in this case arranged along the swirl space formed by the swirl body, as is also the case in single-stage burner systems of the type initially mentioned. This is advantageous in order to inject the fuel into the combustion air entering through the inlet slits, so as thereby to achieve as good intermixing as possible. The present burner is distinguished in that, in the transitional region between the first group and the second group of fuel outlet orifices, a separating element is arranged in the swirl space, said separating element extending in the direction of the combustion chamber and separating the combustion air stream, which enters in the region of the first group via the air inlet orifices, from the combustion air stream which enters in the region of the second group of fuel outlet orifices. This separation in this case takes place at least over a region of the swirl space, that is to say starting from the transitional region in the direction of the combustion chamber into that region of the swirl space in which the second group of fuel outlet orifices is arranged.

The separating element may be both of one-piece and of multipart construction. It is composed exemplarily of a partition surrounding the burner axis. The partition is in this case of tubular design, preferably over at least a part region, in adaptation to the geometric form of the swirl generator. By means of this separating element or this partition within the swirl space, a separate volume is produced, which forms a kind of reduced combustion chamber for the first stage, that is to say the fuel entering the swirl space via the first group of fuel outlet orifices and the fuel/air mixture resulting from this.

In an operating mode of the burner in which essentially the fuel is supplied by means of this first stage, as is the case for start-up, in the idling mode and under a low load of the plant operated by the burner, in particular a gas turbine, in a manner of piloting, the flame is already generated within the volume formed by the separating element.

By virtue of this configuration of the present burner, a higher pulsation becomes possible, even when the plant is under low load, that is to say in the case of a low burner power and low overall adiabatic combustion temperatures. The inventors have recognized, in this context, that, when the first stage is operated without a separating element of this type, on the one hand, the flame can execute relatively free axial pulsations and, on the other hand, these pulsations are assisted by virtue of the cooling effect of the combustion air flowing in through the air inlet orifices in the region of the second stage. By the separating element being inserted between the air streams which flow into the swirl space in the region of the first stage and the air streams which flow in in the region of the second stage, an interaction between these air streams in the case of a low burner power can be prevented. This, in turn, advantageously leads to a reduction in the combustion pulsations.

In an advantageous embodiment, the burner comprises a fuel lance which extends into the region of the separating element or of the volume formed by the separating element. This burner lance is thus prolonged, as compared with the fuel or piloting lances known from the prior art, in conjunction with the burners with single-stage fuel injection. By the fuel lance being prolonged in this way into the volume of the separating element, an additional stabilizing point for the fuel/air mixture by means of the "stage jump" via the lance tip of the first stage is provided, and the axial combustion pulsation is further reduced.

Optionally, the walls of the separating element have cooling ducts, to which combustion air is supplied from upstream of the swirl generator. The cooling ducts in this case extend in the direction of the combustion chamber. The cooling air emerges into the swirl space through corresponding orifices at that end of the separating element which is located on the combustion-chamber side.

The separating element is exemplarily produced integrally with the swirl body or with the shells forming the latter or is fastened thereto. This exemplary embodiment of the burner makes it possible to provide existing burner constructions with the separating element without complicated reconstruction.

BRIEF DESCRIPTION OF THE DRAWINGS

The present burner is briefly explained below, once again, with reference to an exemplary embodiment, in conjunction with the figures, of which.

DETAILED DESCRIPTION OF EXEMPLARY EMBODIMENTS

Figure 1:
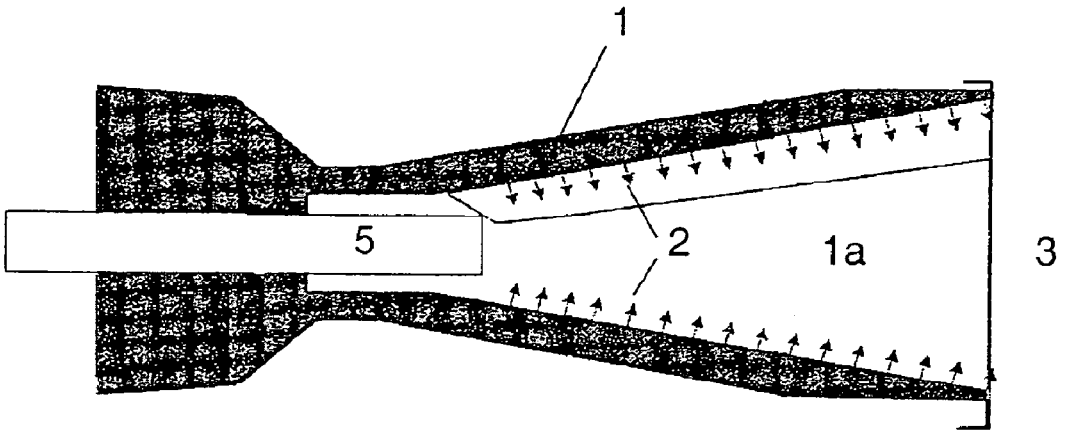
FIG. 1 (Prior Art)
FIG. 1 shows a single-stage burner according to the prior art.

FIG. 1 shows a single-stage burner system, such as is known from the prior art and has already been explained in the description introduction.

In the present exemplary embodiment, a burner geometry is used, such as is known, in principle, from the prior art initially mentioned, in particular from EP 0 321 809 B1. The burner consists of the swirl body 1 which comprises a swirl space 1*a* for intermixing the fuel with the combustion air (indicated by arrows) entering the swirl body 1 via air inlet slits. The swirl space 1*a* is followed by the combustion chamber 3. The swirl generator 1 is designed conically in a known way and consists of a plurality of part shells. The ductlike supplies 4*a* and 4*b* for injecting the fuel into the swirl space 1*a* are arranged in these part shells. In the present burner system, two-stage fuel injection is used, in which a first stage is formed by the fuel supply 4*a* and a second stage by the fuel supply 4*b*. In this context, the figure shows diagrammatically the first group of fuel outlet orifices 2*a* in the first fuel duct 4*a* and the second group of fuel outlet orifices 2*b* in the second fuel duct 4*b*.

Of course, these outlet orifices 2*a*, 2*b* are illustrated merely diagrammatically in the present example, the number, distribution and geometry of these outlet orifices being adapted to the respective conditions.

In this example, the supply line 6 of the fuel to the second stage 4*b* is led along the outer wall of the swirl body 1. The supply for the first stage 4*a* is not shown explicitly in this example.

A fuel lance 5, which runs on the longitudinal axis 7 of the burner, can be seen in the central region of the swirl generator 1.

In this exemplary embodiment of the burner according to the invention, a separating element 8 is provided, which surrounds the longitudinal axis 7 of the burner in the swirl space 1*a* and which has an essentially cylindrical or bowl-shaped design. This separating element 8 separates the combustion air flow entering through the air inlet slits in the region of the first stage 4*a* from the combustion air flow which enters the outer zone of the swirl space 1*a* in the region of the second stage 4*b*. The flow path of the entering combustion air can be seen from the two arrows. The separating element 8 in this case forms a kind of can which is open toward the combustion chamber 3. In this example, the fuel lance 5 is prolonged, as compared with known arrangements, and extends approximately midway into the volume formed by the separating element 8. By virtue of this arrangement, a separation of the combustion air flow entering in the region of the two stages 4*a* and 4*b* is achieved, so that no interaction takes place between the two flows. The separating element 8 in this case does not extend as far as that edge of the swirl generator 1 which is located on the combustion-chamber side, but only over a part region.

Under low load or when the burner power is low, the fuel is injected mainly through the fuel outlet orifices 2*a* of the first stage 4*a* into the inner zone of the swirl space 1*a*, that is to say into the combustion air entering the swirl space in this region. A combustion zone, illustrated diagrammatically in the figure by the reference symbol 9, is thereby formed at that edge of the separating element 8 which is located on the combustion-chamber side. This combustion of the fuel of the first stage 4*a* in said operating mode is not disturbed by the combustion air flow entering in the region of the second stage 4*b*, since the flame root is located within the separating element. Possible combustion pulsations are thereby markedly reduced, and the stability of the flame is improved, in particular, by means of the prolonged fuel lance 5 which generates a step jump (backward-facing step).

Figure 2:
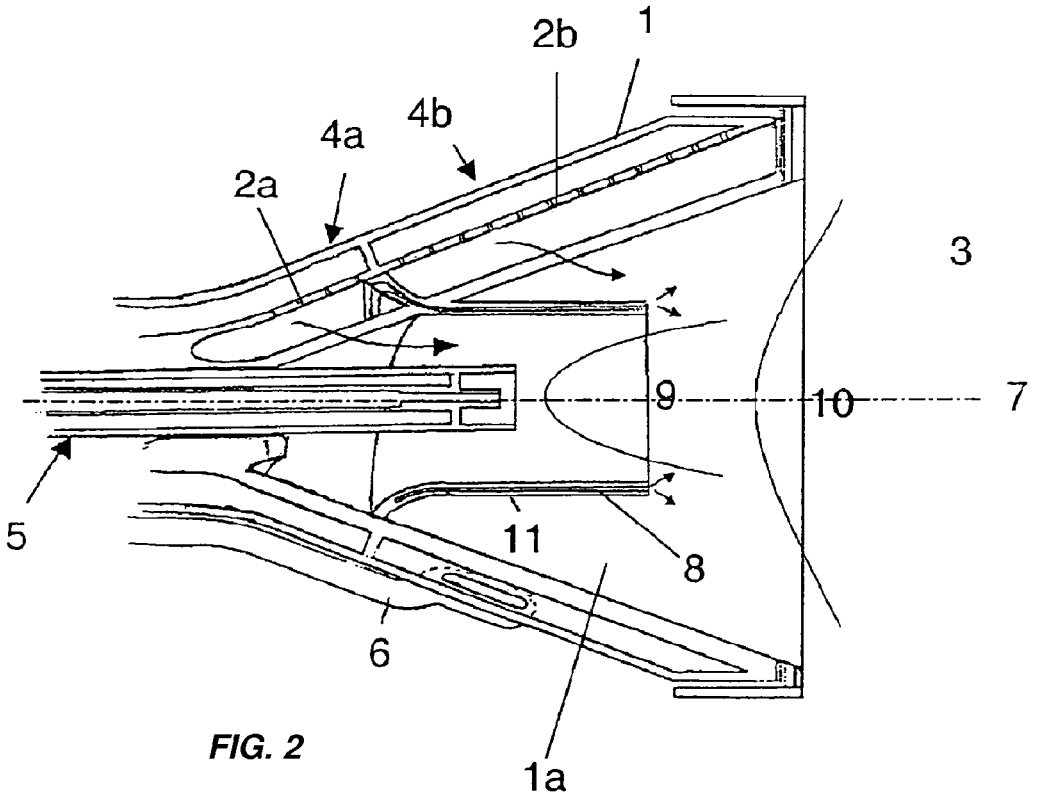
FIG. 2 shows an example of a present burner in a diagrammatic illustration.

It is not intended, in this case, to introduce gaseous fuel via the lance. The two ducts which can be seen in the lance in FIG. 2 are for lance cooling air and for the possibility of the introduction of liquid fuel for double-fuel operation via the centrally arranged flat-jet nozzle.

In the case of a higher burner power, larger fuel quantities are injected additionally by means of the second stage 4*b*, with the result that, at the end, the combustion zone is displaced into the region indicated diagrammatically by the reference symbol 10. At the higher combustion temperatures already occurring in this operating mode, the pulsation problems no longer arise to the extent to which they arise in the case of low powers. By means of the partition, the flame root of the flame which is generated by the fuel introduced via the second stage 4*b* is also still anchored, together with the flame 9, in or at the partition outlet.

The cooling system for the separating element 8 in the form of cooling ducts 11 can also be seen very clearly in the figure. These cooling ducts 11 are connected to the combustion air entering the swirl generator 1 upstream of the second stage and have their outlet orifices at that end of the walls of the separating element 8 which is located on the combustion-chamber side. The emerging combustion air is indicated by the arrows in this region.

It goes without saying that the present invention can also be applied to other burner geometries which are operated via an at least two-stage injection of fuel into the combustion air. The essential element, in this case, is the separating element which separates from one another the combustion air flows entering in the region of the two stages. This separation is necessary at least in a part region for the swirl space.

LIST OF REFERENCE SYMBOLS

1 Swirl generator
1*a* Swirl space
2 Fuel outlet orifices
2*a* Fuel outlet orifices of the first stage
2*b* Fuel outlet orifices of the second stage
3 Combustion chamber
4*a* Fuel supply of the first stage
4*b* Fuel supply of the second stage
5 Fuel lance
6 Fuel line
7 Longitudinal axis of the burner
8 Separating element
9 Combustion zone 1
10 Combustion zone 2
11 Cooling ducts While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A burner with staged fuel injection, comprising:

a swirl generator for a combustion air stream;

inlet orifices for the combustion air stream; and means for the introduction of fuel into the combustion air stream comprising at least one first fuel supply with a first group of fuel outlet orifices and a second fuel supply with a second group of fuel outlet orifices downstream of the first group of fuel outlet orifices, the first and second group of fuel outlet orifices and the inlet orifices for the combustion air stream being arranged along a swirl space formed by the swirl generator, a transitional region between the first and the second group of fuel outlet orifices including a separating element arranged in the swirl space, said separating element having walls with an end and separating, at least over a portion of a longitudinal axis of the burner, a first combustion air stream, which enters the swirl space in the region of the first group of fuel outlet orifices, from a second combustion air stream which flows into the swirl space in the region of the second group of fuel outlet orifices, the separating element comprising cooling ducts passing therethrough, wherein the cooling ducts comprise outlet orifices at the end of the walls of the separating element directed toward the combustion chamber.

2. The burner as claimed in claim 1, wherein the separating element comprises one or more partitions which surround the longitudinal axis of the burner.

3. The burner as claimed in claim 1, wherein the separating element is tubular.

4. The burner system as claimed in claim 1, wherein the burner comprises a central fuel lance, which extends into a volume formed by the separating element.

* * * * *